US005960848A

United States Patent [19]

Schirer

[11] Patent Number: 5,960,848

[45] Date of Patent: Oct. 5, 1999

[54] PORTABLE DISPLAY BOARD

[75] Inventor: Jack L. Schirer, Grapevine, Tex.

[73] Assignee: Excel Packaging, Inc., Dallas, Tex.

[21] Appl. No.: 08/997,214

[22] Filed: Dec. 22, 1997

[51] Int. Cl.[6] ..... A47G 5/00

[52] U.S. Cl. ..... 160/135; 40/539

[58] Field of Search ..... 160/135, 351, 160/229.1; 40/605, 606, 610, 539, 124.19

[56] References Cited

U.S. PATENT DOCUMENTS

| | | | |
|---|---|---|---|
| 1,467,624 | 9/1923 | Nash . | |
| 1,576,672 | 3/1926 | Miller . | |
| 1,702,701 | 2/1929 | Naimark . | |
| 1,723,944 | 8/1929 | Marsh . | |
| 1,853,615 | 4/1932 | Howard . | |
| 2,911,038 | 11/1959 | Frommelt | 160/351 |
| 3,469,335 | 9/1969 | Leigh | 40/124.1 |
| 3,562,973 | 2/1971 | Gangemi | 160/135 |
| 3,601,916 | 8/1971 | Epstein | 40/125 |
| 3,662,807 | 5/1972 | Miller | 160/135 |
| 4,200,254 | 4/1980 | Nelson | 160/351 X |
| 4,275,520 | 6/1981 | Appleton | 40/605 |
| 4,738,041 | 4/1988 | Drueck | 40/606 X |
| 4,759,520 | 7/1988 | Levine | 248/174 |
| 4,794,712 | 1/1989 | Wood | 40/605 |
| 5,293,705 | 3/1994 | Wood | 40/124.1 |
| 5,323,836 | 6/1994 | Tuttle et al. | 160/135 |
| 5,355,555 | 10/1994 | Zarelius | 160/135 X |
| 5,632,390 | 5/1997 | Podergois | 40/605 |
| 5,771,954 | 6/1998 | Benner et al. | 160/135 X |

*Primary Examiner*—David M. Purol
*Attorney, Agent, or Firm*—Baker & Botts, L.L.P.

[57] ABSTRACT

A portable display board (10) is disclosed. The portable display board (10) comprises a center portion (12), a left portion (14) hingedly attached to the center portion (12) and a right portion (16) hingedly attached to the center portion (12). Also included is a header (20), hingedly attached to the center portion (12). The header (20) comprises a center header portion (24), a left header portion (22) hingedly attached to the center header portion (24) and a right header portion (26) hingedly attached to the center header portion (24). To assemble, the left portion (14) and the right portion (16) move inwards towards the center portion (12). The header portion (20) folds over and secures onto the left portion (14), the right portion (16) and the center portion (12) in such a way as to hold the left portion (14) and the right portion (16) at a correct angle relative to the center portion (12) for maximum stability. The portable display board (10) is also operable to fold up into a transportable configuration. A handle (30) may be provided for ease of transportation.

17 Claims, 6 Drawing Sheets

FIG. 3A
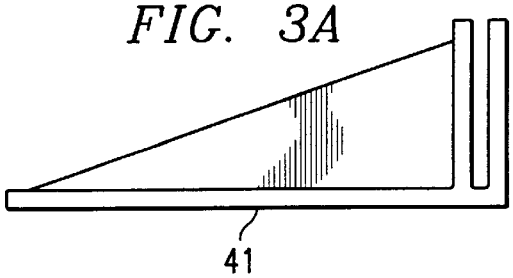
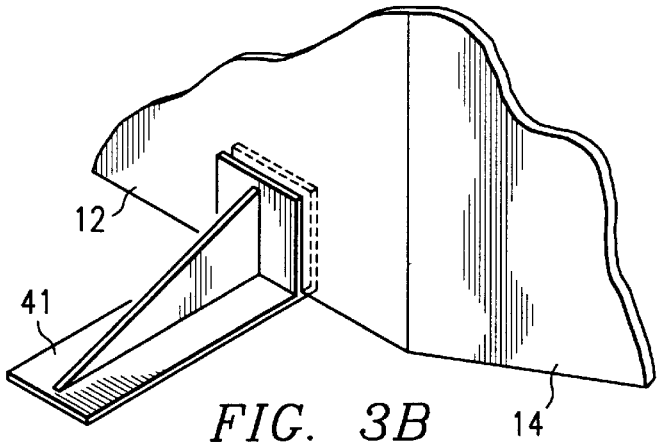
FIG. 3B
FIG. 3C
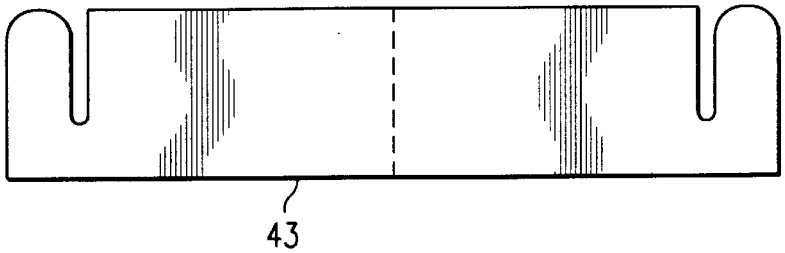
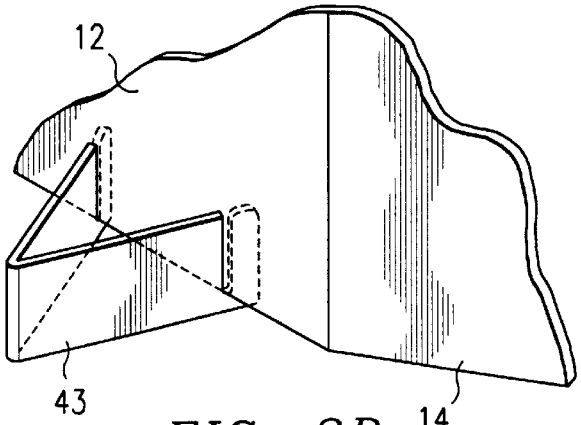
FIG. 3D

PORTABLE DISPLAY BOARD

TECHNICAL FIELD OF THE INVENTION

This invention relates generally to the field of display devices and more particularly to a portable display board.

BACKGROUND OF THE INVENTION

Primary and secondary school students are often required to construct displays for science fairs and the like. Often, these displays are constructed from poster board or similar material. Unfortunately, poster board is a very flexible material and can collapse under the weight of the display. To solve this problem, some type of support can be built to hold the poster board. The result is an awkward and hard to transport display.

In an effort to overcome these disadvantages, various modifications have been suggested. One approach is described in U.S. Pat. Nos. 4,794,712 and 5,293,705, both entitled "Portable Display Device," issued on Jan. 3, 1989 and Mar. 15, 1994 to Donald L. Wood. Wood discloses a display board having a center panel and a pair of side panels hingedly attached to the center panel. The side panels are designed to fold in at an angle from the open position, which allows for viewing of the displayed material and support of the display board.

The drawback of this approach is that the sides do not always Stay in the proper position. Instead, the sides have a tendency to fold back into their closed position, causing the display board to fall over, potentially destroying the displays One solution to this problem has been to use one or more objects to hold the panels in position. This approach is unsatisfactory because it detracts from the visual appearance of the display. Additionally, even though the sides are able to fold, the display board does not fold into an easily transportable configuration.

Therefore, a need has arisen for a portable display board that overcomes the disadvantages of the prior art.

SUMMARY OF THE INVENTION

From the foregoing, it may be appreciated that a need has arisen for an improved portable display board. In accordance with the present invention, a portable display board is provided which substantially eliminates or reduces the disadvantages and problems associated with current display boards.

In one embodiment, a portable display board is disclosed. The portable display board comprising a display area having a center portion including a center slot, a left portion hingedly attached to the center portion and including a left portion slot and a right portion hingedly attached to the center portion and including a right portion slot. Also included is a header portion, hingedly attached to the center portion. The header portion comprises a center header portion having a center header tab, a left header portion hingedly attached to the center header portion and including a left header slot, and a right header portion hingedly attached to the center header portion and including a right header slot. The left portion and the right portion are operable to move inward towards the center portion. The header portion is operable to fold over in such a way that the left header slot inserts into the left portion slot, the right header slot inserts into the right portion slot and the center header tab inserts into the center portion slot, thereby forming a completed display board.

In another embodiment, a method for manufacturing a portable display board is provided. The method comprises three steps. In the first step, the general shape of the portable display board is cut out from a suitable material. Perforations are then added in a second step, forming a center portion, a right portion and a left portion. In step three a horizontal perforation is cut through the left portion, the right portion and the center portion.

One technical advantage is that the invention provides a method for manufacturing a portable display board. Another technical advantage is that the invention provides a portable display board that is stable and resists collapsing. Another technical advantage is that the invention provides a portable display board that can fold into an easily transportable configuration.

BRIEF DESCRIPTION OF THE DRAWINGS

For a more complete understanding of the present invention, the objects and advantages thereof, reference is now made to the following descriptions taken in connection with the accompanying drawings in which:

FIGS. 3A, 3B, 3C and 3D illustrate optional feet which attach to the center portion of the display board in accordance with the teachings of the present invention;

DETAILED DESCRIPTION OF THE INVENTION

The preferred embodiment of the present invention and its advantages are best understood by referring to FIGS. 1 through 5 of the drawings, like numerals being used for like and corresponding parts of the various drawings.

Figure 1:
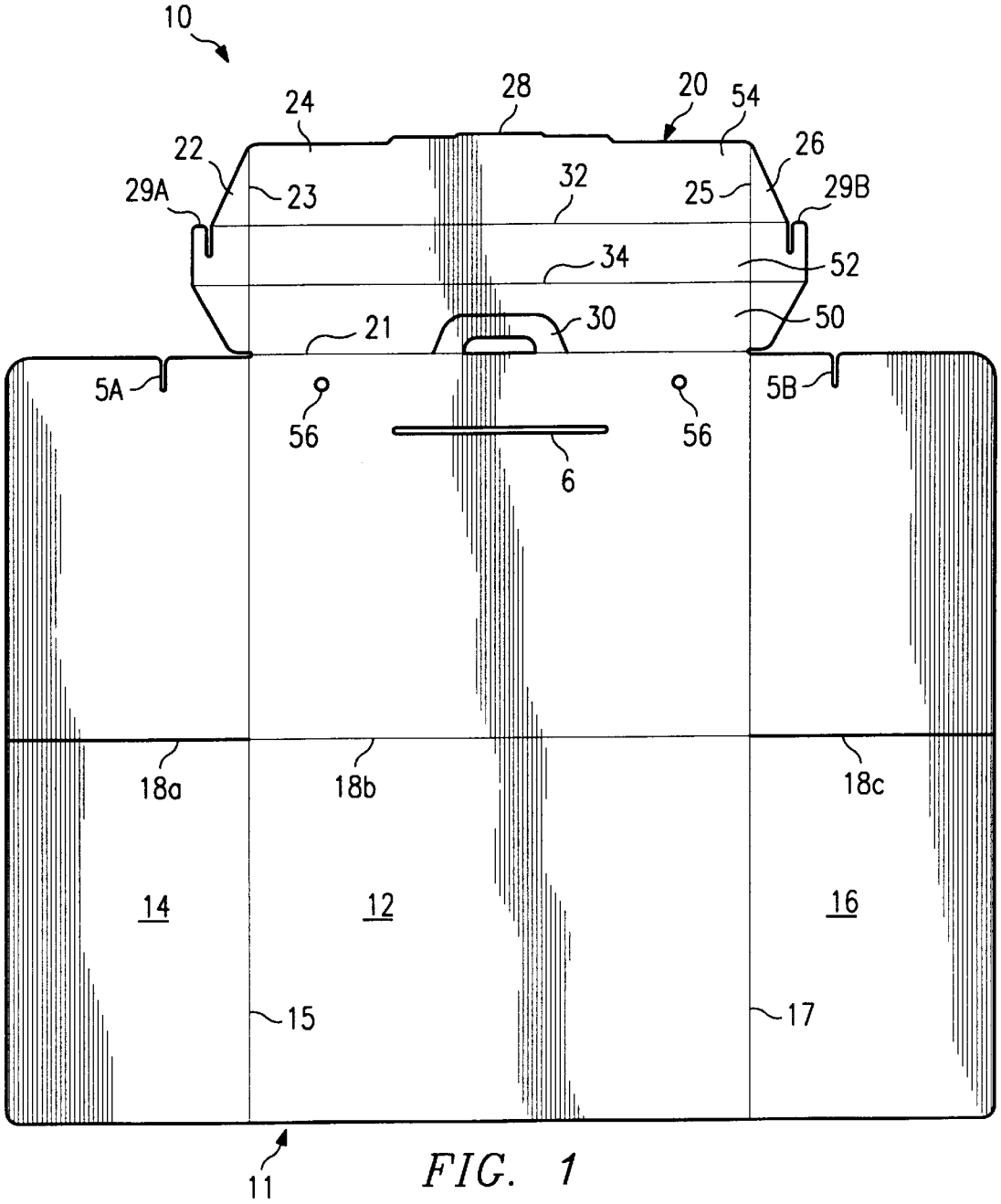
FIG. 1 illustrates the portable display board before assembly in accordance with the teachings of the present invention.

FIG. 1 illustrates a portable display board 10, before assembly, in accordance with the teachings of the present invention. Portable display board 10 comprises a display area 11 comprising a left portion 14, a center portion 12, and a right portion 16. Header portion 20 is operable to attach to display area 11 to form portable display board 10.

In one embodiment, portable display board 10 includes center portion 12 having a center slot 6 located near the top of center portion 12. Left portion 14 is hingedly attached to center portion 12 along a left perforation 15 and includes a left portion slot 5A. Right portion 16 is hingedly attached to center portion 12 along a right perforation 17 and includes a right portion slot 5B. Additionally, a left horizontal perforation 18*a* runs horizontally across left portion 14, a horizontal perforation 18*b* runs horizontally across center portion 12, and a right horizontal perforation 18*c* runs horizontally across right portion 16, dividing portable display board 10 into a top portion and a bottom portion. Portable display board 10 folds along horizontal perforations, 18*a*, 18*b* and 18*c* for storage and transport, as will be discussed later in greater detail. In an alternative embodiment, multiple horizontal perforations may be provided to allow display board 10 to be folded into a more compact size. Additionally, holes 56 are provided to allow portable display board 10 to hang on a wall or similar structure for viewing.

Header portion 20 is hingedly attached to center portion 12 at a header perforation 21. Header portion 20 comprises a center header portion 24 having a center header tab 28. A left header portion 22, having a left header slot 29A, is hingedly attached along a perforation 23 to center header portion 24. A right header portion 26, having a right header slot 29B, is hingedly attached along a perforation 25 to center header portion 24. Header portion 20 also includes two header perforations, 32 and 34, which divides header portion 20 into a lower header portion 50, a middle header portion 52 and an upper header portion 54. Header perforations 32 and 34 facilitate folding of header portion 20. A handle 30 is provided for use when portable display board 10 is folded into a transportable configuration.

In another embodiment, portable display board 10 comprises two separate pieces—header portion 20 and display area 11 comprising the left, center and right portions 14, 12, and 16.

Figure 2:
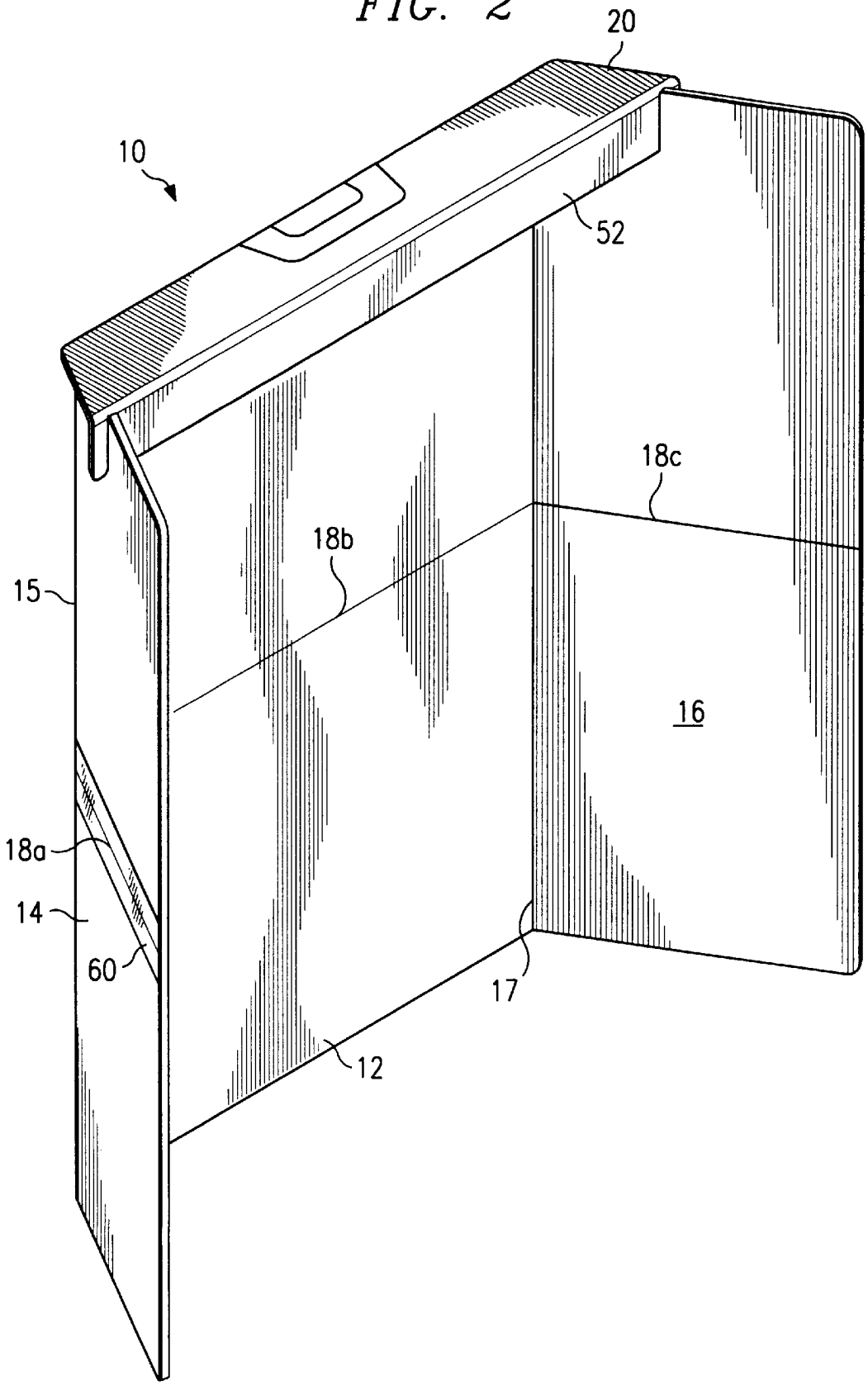
FIG. 2 illustrates the assembled portable display board in accordance with the teachings of the present invention.

In another embodiment, left horizontal perforation 18*a* and right horizontal perforation 18*c* may be provided as a cut that completely severs all layers of material. Referring to FIG. 2, in this embodiment, a strip 60, with a flexible adhesive backing, such as rubber or neoprene, may be attached to portable display board 10 where the cut is made. Strip 60 is illustrated as covering left horizontal perforation 18*a* on left portion 14. A similar strip 60 is provided to cover right horizontal perforation 18*c*. In this manner, portable display board 10 is still operable to be folded into a transportable configuration and unfolded into portable display board 10. Alternatively, a non-flexible adhesive material may be used for strip 60 if the material is attached in such a way as to allow portable display board 10 to fold into a transportable configuration as well as to help maintain the shape of portable display board 10 when assembled. Such non-flexible material for strip 60 would typically have to have excess material in the area covering the cut through left horizontal perforation 18*a* and right horizontal perforation 18*c*. Alternatively, if a complete cut is made through left and right horizontal perforations, 18*a* and 18*c*, non-flexible material may be applied to the front of left and right portions, 14 and 16, of display board 10 to allow it to maintain its shape when assembled and to fold for portability. This embodiment has the advantage of ease of manufacturing.

Portable display board 10 may be manufactured from any suitable material including, but not limited to, rigid paper or plastic material. In one embodiment, portable display board 10 is manufactured using corrugated paperboard. In this embodiment, each panel and the header comprises a base portion of virgin/recycled kraft, oyster/modled/clay white, bleach white or laminated paper, or any combination thereof. Attached to one side of the base portion is a substantially rigid section of corrugated material, solid fiber or foam core. On the other side of the corrugated material, solid fiber or foam core is a front section of essentially the same materials as the base portion.

To manufacture portable display board 10, the general shape as shown in FIG. 1 is cut out from a suitable material such as one of the materials listed above. Score lines are formed where left perforation 15 and right perforation 17 are shown dividing the portable display board into left portion 14, center portion 12 and right portion 16. Another score line is formed along the line where horizontal perforations 18*a*, 18*b*, and 18*c* are shown. Left portion slot 5A and right portion slot 5B are formed at the top of left portion 14 and right portion 16. Center slot 6 is cut out near the top of center portion 12.

A score line is formed where header perforation 21 is shown. Additionally, perforations 23 and 25 are formed, dividing header portion 20 into left header portion 22, center header portion 24 and right header portion 26. Center header tab 28 is provided when the general shape of portable display board 10 is formed. Left and right header slots, 29A and 29B, are cut out on left and right header portions, 22 and 26. Additional header perforations, 32 and 34, are provided on header portion 20 to allow for the folding of header portion 20. This divides header portion 20 into lower header portion 50, middle header portion 52 and upper header portion 54.

Figure 5A:
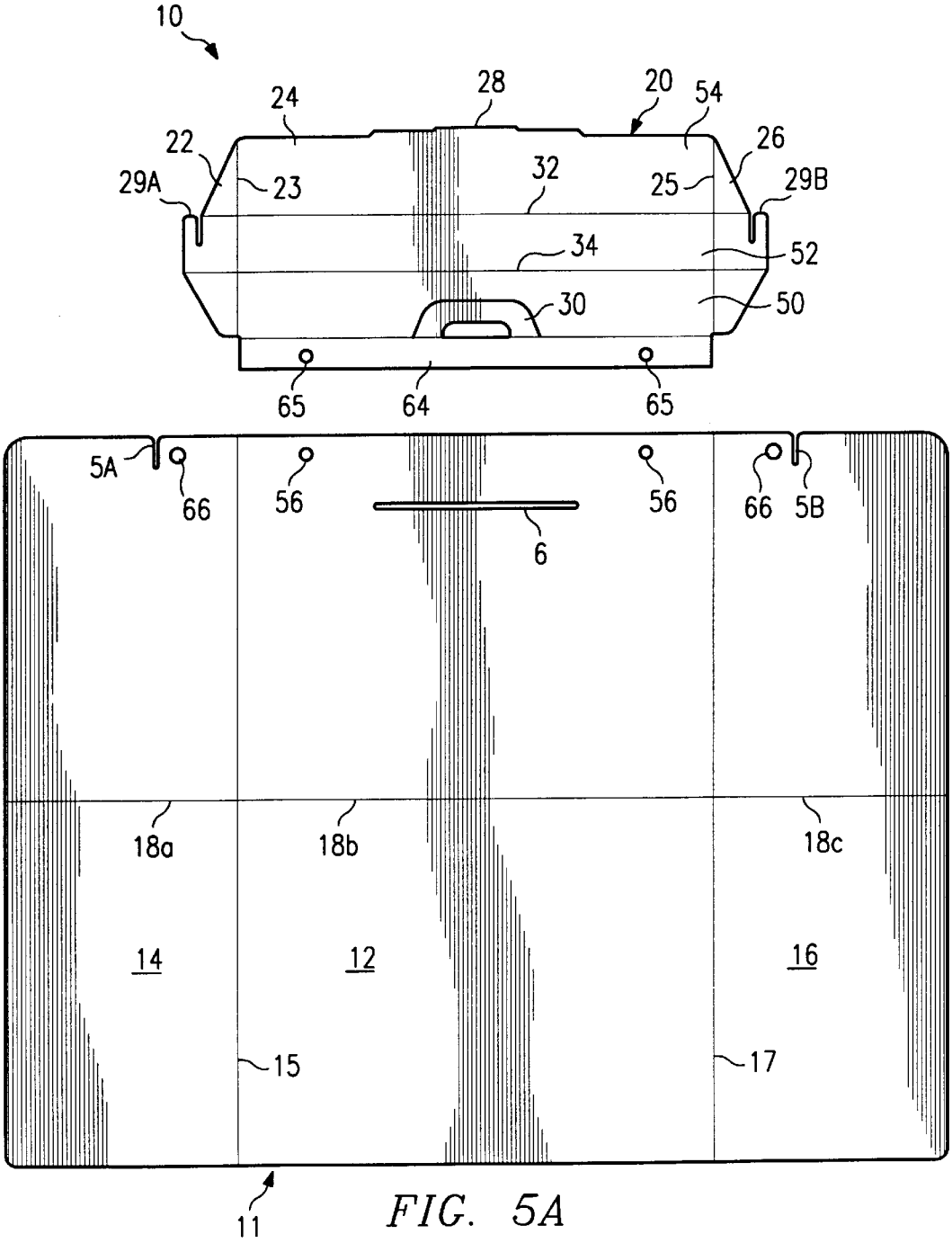

Alternatively, as shown in FIG. 5A, header portion 20 and display area 11 may be manufactured as two separate pieces. In this embodiment a means for attaching header portion 20 to display area 11 may be provided. This embodiment is discussed in greater detail in FIGS. 5A and 5B.

While the flexible connections in portable display board 10 are referred to as "perforations" or "score lines", the connections may also be made by means of a score, perforation, hinge score, slit/cut score or any combination thereof. A score is a fold without a cut through the material. A perforation is a series of cuts or a cut along with or without a score. A hinge score is a cut, score and then a transverse cut. A slit/cut score is a cut through one layer of material and partially or fully through the center section of material.

FIG. 2 illustrates the assembled portable display board 10 in accordance with the teachings of the present invention.

Now referring to FIGS. 1 and 2, assembly of portable display board 10 will be described. To assemble portable display board 10 for use, left portion 14 is folded inward along left perforation 15 towards center portion 12 and right portion 16 is folded inward along right perforation 17 towards center portion 12. Left header portion 22 and right header portion 26 are left in their open positions. Left and right header slots, 29A and 29B, are inserted into right and left portion slots, 5A and 5B, then center header tab 28 of upper header portion 54 is inserted into center slot 6. This causes header portion 20 to fold along header perforations 21, 32 and 34. The result is illustrated in FIG. 2. Center portion 12, left portion 14 and right portion 16 are in the proper position to display the subject matter of the display. Header portion 20 is folded in position and holds portable display area 11 in place and maintains the shape of portable display board 10. Also, a user of portable display board 10 may use middle header portion 52 of header portion 20 to place the name of the project or other identifying information.

In another embodiment, upper header portion 54 may be omitted from header portion 20. In this embodiment, left and right header slots, 29A and 29B, are inserted into left and right portion slots, 5A and 5B. This holds portable display area 11 in place and maintains the shape of portable display board 10. In this embodiment, since upper header portion 54 is omitted, center header tab 28 is also omitted and, therefore center slot 6 is not needed.

In another embodiment, portable display board 10 comprises two separate pieces, header portion 20 and display area 11 comprising left portion 14, center portion 12, and right portion 16. Header portion 20 comprises middle header portion 52 and upper header portion 54. In this embodiment, left and right header slots, 29A and 29B, are inserted into left and right portion slots, 5A and 5B. Center header tab 28 of upper header portion 54 is inserted into center slot 6.

In another embodiment, header portion 20 is provided as a footer and portable display board 10 is provided as an inverted portable display board 10.

FIGS. 3A, 3B, 3C and 3D illustrate optional bottom supports, 41 and 43, which attach to the bottom of center portion 12 of portable display board 10 in accordance with the teachings of the present invention. FIG. 3A illustrates bottom support 41 which may be comprised of plastic or similar material and is illustrated in FIG. 3B attached to the bottom of center portion 12. FIG. 3C illustrates bottom support 43 comprised of the same material as portable display board 10 and is illustrated in FIG. 3D attached to the bottom of center portion 12. Bottom supports, 41 and 43, are typically deployed in pairs to support portable display board 10.

Figure 4A:
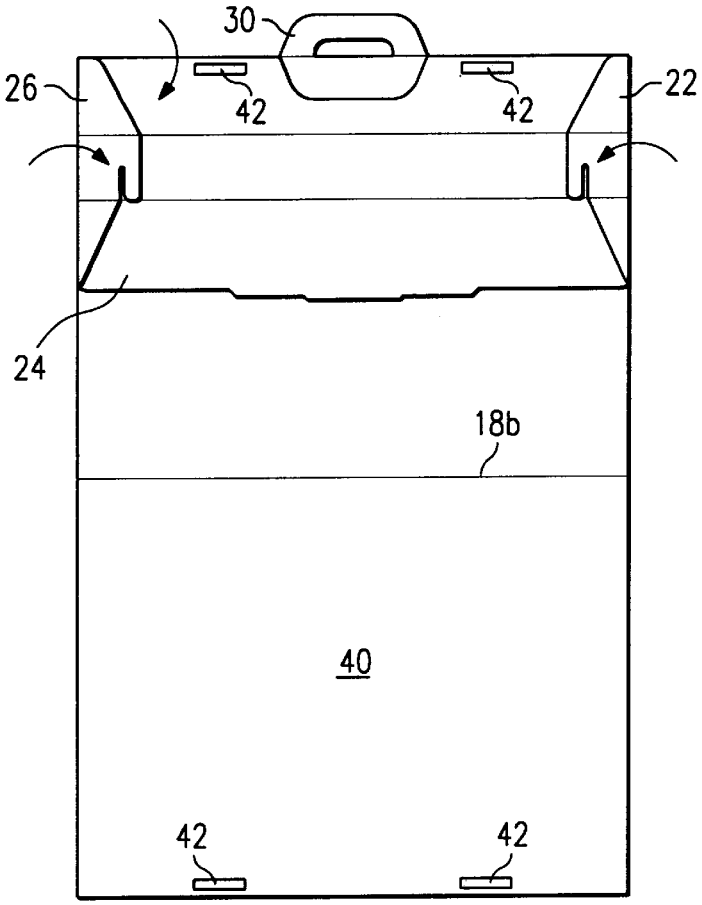
FIGS. 4A and 4B illustrate the folding of the portable display board into a transportable configuration in accordance with the teachings of the present invention; and, FIGS. 5A and 5B illustrate another embodiment of the present invention in accordance with the teachings of the present invention.
Figure 4B:
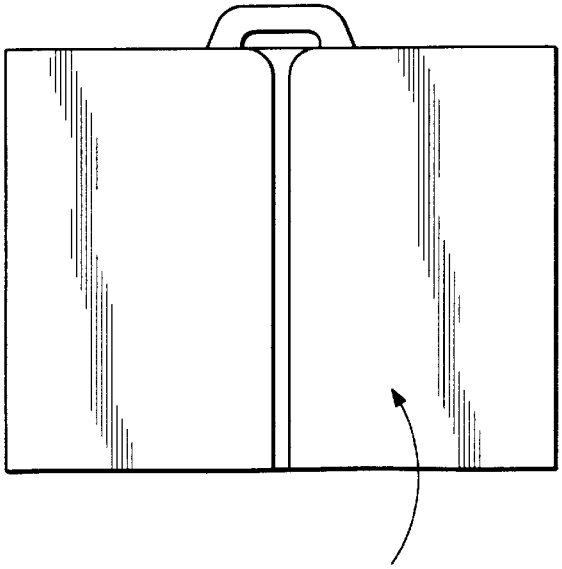

FIGS. 1, 4A and 4B illustrate the folding of portable display board 10 into a transportable configuration in accordance with the teachings of the present invention. Starting with FIG. 1, left portion 14 and right portion 16 fold inward towards center portion 12 while header portion 20 folds backward with respect to the illustration of FIG. 1. FIG. 4A illustrates the result as viewed from the opposite side of FIG. 1. Left header portion 22 and right header portion 26 are folded inward to center header portion 24. Handle 30 is folded out. Also shown in FIG. 4A is a double strip of hook and loop fasteners 42 located on center header portion 24 and at a bottom portion 40 of center portion 12. While hook and loop fasteners may be used, other fastening means such as plastic clips, buttons, snaps or other means of fastening may also be used. FIG. 4B illustrates the final position where bottom portion 40 of center portion 12 is folded upwards along horizontal perforations 18*a*, 18*b*, and 18*c*, and secured by hook and loop fasteners 42 at center header portion 24.

As seen in FIG. 4B, portable display board 10 is now folded into a transportable configuration which is easily carried via handle 30.

Figure 5B:
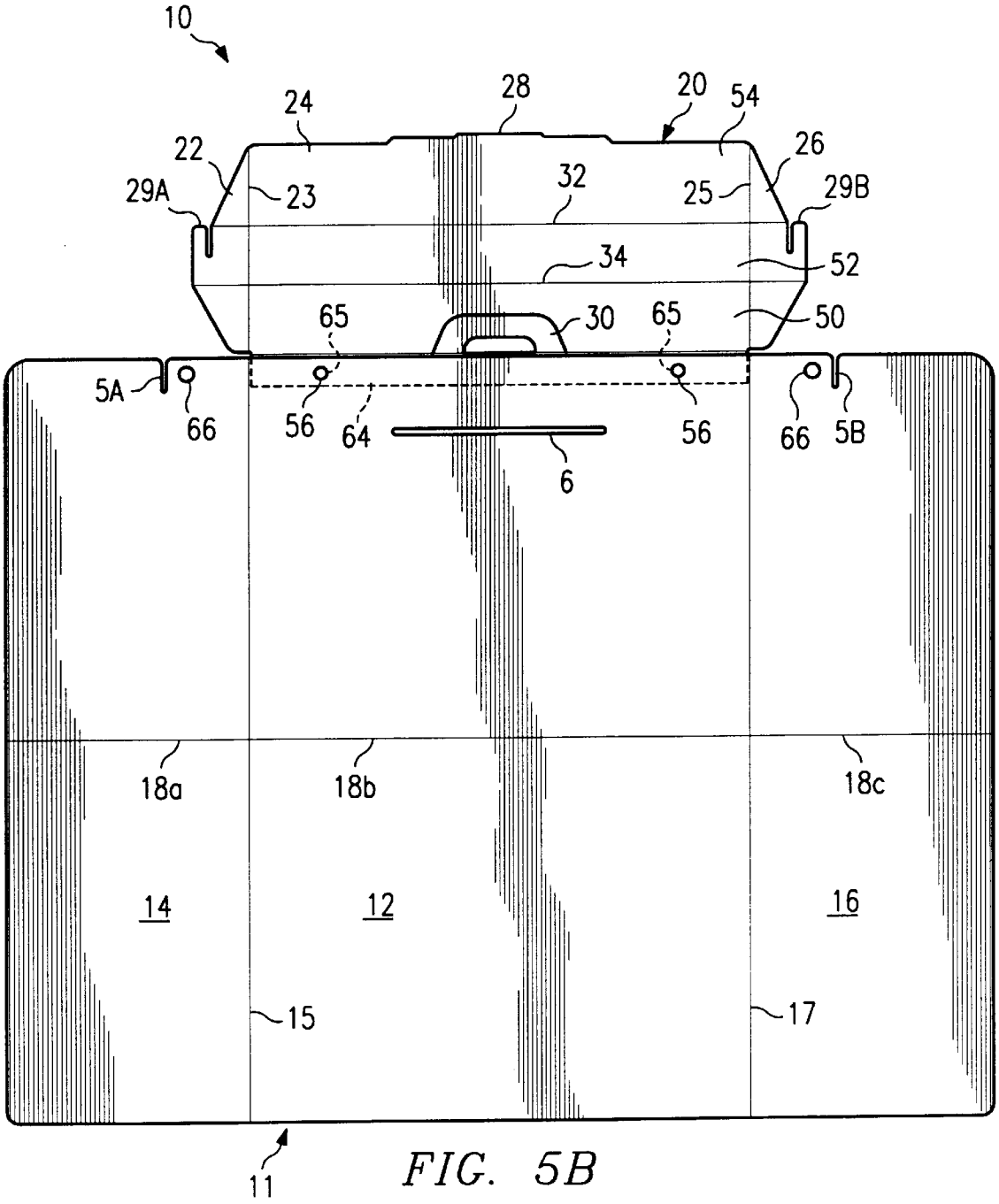

FIGS. 5A and 5B illustrate another embodiment of the present invention in accordance with the teachings of the present invention. In FIG. 5A, portable display board 10 is provided as two separate pieces, display area 11 and header portion 20. One reason to provide portable display board 10 as two separate pieces is for ease of manufacturing. As before, display area 11 comprises center portion 12, right portion 16, left portion 14 and horizontal perforations 18*a*, 18*b*, and 18*c*.

Header portion 20 is constructed as in FIG. 1 with the addition of an attachment panel 64. Attachment panel 64 provides an area where header portion 20 may be attached to display area 11. Attachment material may be paste, glue, adhesive tape, staples or any other attachment material. Header portion 20 is shown attached to center portion 12 of display area 11 in FIG. 5B. Header portion 20 may be attached by the consumer or prior to sale during the manufacturing process.

Alignment holes 66 may be provided, one on left portion 14 and one on right portion 16. Additionally, panel holes 65 may also be provided on attachment panel 64. Panel holes 65 will be spaced the same distance apart as holes 56 on center portion 12. Alignment holes 66 will typically be larger than holes 56 and panel holes 65. The purpose of alignment holes 66 is to help in the attachment of header portion 20 onto center portion 12 of display area 11. In operation, left portion 14 and right portion 16 are folded Inwards towards center portion 12. Alignment holes 66 should now overlap with holes 56. A pin or similar device can now be used to go through alignment holes 66 and holes 56, protruding through holes 56. Header portion 20 can now be placed on center portion 12 by aligning panel holes 65 with the pins. Placing pins through panel holes 65 (typically after applying attachment material), header portion 20 is now attached and aligned with center portion 12.

Once header portion 20 is attached to center portion 12, and the portable display board 10 is hung on the wall, the double thickness provided by center portion 12 of display area 11 and attachment panel 64 of header portion 20 helps support portable display board 10.

In an alternative embodiment, handle 30 may be provided directly on center portion 12 of display area 11. In this embodiment, display area 11 is operable to be folded along left perforation 15 and right perforation 17 and then along horizontal perforations 18*a*, 18*b* and 18*c*. Display area 11 is then in a transportable configuration and can be carried by handle 30.

While the invention has been particularly shown and described by the foregoing detailed description, it will be understood by those skilled in the art that various other changes in form and detail may be made without departing from the spirit and scope of the invention.

What is claimed is:

1. A portable display board comprising:

a center portion;

a left portion hingedly attached to the center portion and including a left portion slot;

a right portion hingedly attached to the center portion and including a right portion slot; and, a header, hingedly attached to the center portion and comprising:

a center header portion;

a left header portion hingedly attached to the center header portion and including a left header slot;

a right header portion hingedly attached to the center header portion and including a right header slot; wherein the left portion and the right portion are operable to move inward towards the center portion and the header portion is operable to have the left header slot insert into the left portion slot, and the right header slot insert into the right portion slot thereby forming a completed display board; and, wherein the center portion further comprises a center slot and the center header portion further comprises a center header tab, the center header tab operable to be inserted into the center portion slot.

2. The portable display board of claim 1, further comprising a pair of bottom supports operable to be inserted at the bottom of the center portion.

3. The portable display board of claim 1, wherein the left portion and the right portion are operable to fold inwards towards the center portion, the left header portion and the right header portion operable to fold inwards towards the center header portion, the header operable to fold backwards with respect to the direction of the left portion and the right portion, and a bottom portion of the center portion operable to fold towards the center header portion along the horizontal perforation, forming a transportable configuration.

4. The portable display board of claim 3, further comprising a handle attached to the header portion for transporting the display board.

5. The display board of claim 3, wherein the display board is fastened in a transportable configuration.

6. The portable display board of claim 5, wherein the display board is fastened in a transportable means using hook and loop fasteners.

7. The portable display board of claim 1, wherein a horizontal cut is provided in the left portion and the right portion.

8. The portable display board of claim 7, wherein the cuts are covered by a strip.

9. The portable display board of claim 7, wherein the strip comprises a flexible adhesive material.

10. The portable display board of claim 7, wherein the right portion and the left portion are covered with paper, such that the cuts are covered.

11. A portable display board comprising:

a center portion a right portion hingedly attached to the center portion;

a left portion hingedly attached to the center portion;

a perforation extending horizontally across the display area dividing the display area into a top portion and a bottom portion; and, a header portion operable to attach to the top portion of the display board using an attachment panel, the header portion comprising:

a center header portion, a right header portion hingedly attached to the center header portion and including a right header slot;

a left header portion hingedly attached to the center portion and including a left header slot;

a lower header portion hingedly attached to a middle header portion;

an upper header portion hingedly attached to the middle header portion; and, a center header tab formed on the center header portion;

wherein the header attaches to the display board by inserting the right header slot into a right portion slot formed on the right portion and by inserting the left header slot into a left portion slot formed on the left portion and by inserting the center header tab into a center slot formed on the center portion.

12. The portable display board of claim 11, wherein the portable display board is operable to be folded into a transportable configuration by folding the right portion in towards the center portion, folding the left portion in towards the center portion and folding along the horizontal perforation.

13. The portable display board of claim 11, wherein the display board is fastened in a transportable configuration.

14. The portable display board of claim 13, wherein the display board is fastened in a transportable configuration using hook and loop fasteners.

15. The portable display board of claim 11, further comprising a handle mounted on the portable display board.

16. The portable display board of claim 11, wherein holes are provided on the center portion and on the attachment panel of the header, the holes operable to lineup when the header is attached to the center portion and to provide support for mounting the portable display board on a wall.

17. The portable display board of claim 16, further comprising an alignment hole located on the left portion and an alignment hole located on the right portion, the alignment holes operable to overlap with the holes on the center portion when the left portion and the right portion are folded inward towards the center portion, the overlapping of the alignment holes and the holes on the center portion providing a means for aligning the header portion with the center portion for attachment.

* * * * *